US006070272A

United States Patent [19]

Chiang

[11] Patent Number: 6,070,272

[45] Date of Patent: Jun. 6, 2000

[54] GOGGLES WITH CONNECTING PLATE ASSEMBLY AT OUTER ENDS

[76] Inventor: Herman Chiang, 2F, No. 634-9, Ching-Ping rd., Chung-Ho city, Taipei Hsien, Taiwan

[21] Appl. No.: 09/209,531

[22] Filed: Dec. 11, 1998

[51] Int. Cl.[7] ..... A61F 9/02

[52] U.S. Cl. ..... 2/442; 2/428; 2/445

[58] Field of Search ..... 2/428, 430, 439, 2/445, 452, 442

[56] References Cited

U.S. PATENT DOCUMENTS

| | | | |
|---|---|---|---|
| 4,468,819 | 9/1984 | Ohno | 2/430 |
| 5,596,771 | 1/1997 | Hsu et al. | 2/428 |
| 5,644,800 | 7/1997 | Leonardi | 2/431 |
| 5,650,866 | 7/1997 | Haslbeck | 359/43 |
| 5,687,428 | 11/1997 | Yamamoto | 2/445 |
| 5,727,259 | 3/1998 | Kawamata | 2/452 |
| 5,867,841 | 2/1999 | Chiang | 2/436 |
| 5,890,237 | 4/1999 | Herman | 2/440 |
| 5,901,382 | 5/1999 | Chiang | 2/445 |
| 5,903,929 | 5/1999 | Chou | 2/441 |

*Primary Examiner*—John J. Calvert
*Assistant Examiner*—Katherine Moran
*Attorney, Agent, or Firm*—Pro-Techtor International Services

[57] ABSTRACT

The creation is to provide a type of new structure for swimming goggle. It is a one piece swimming goggle consists of the lens frames, nose rest and protective pads. The main features of the swimming goggle lies with: the combined mount of the frame comprises no less than one vertical rib in partitioning into no less than two assembly areas, and through the assembly areas, the headband of the swimming goggle can go through, and wind over the rib so that when putting on the swimming goggle, the pull force is absorbed by the rib to ensure that the frame shall not distort in achieving distributing the pull force while wearing the swimming goggle. The simplified structure shall enable cost reduction.

3 Claims, 4 Drawing Sheets

GOGGLES WITH CONNECTING PLATE ASSEMBLY AT OUTER ENDS

SCOPE OF THE PATENT

The invention primarily related to the type of goggle used in pool-swimming. It particularly cooncerns further improvement on the one-piece formed lens frame, nose rest and protective pads. The preferred embodiment to swimming goggle aims to provide wearing comfort and fine anti-leakage properties.

BACKGROUND OF THE INVENTION

Where swimming goggle expressedly designed for pool swimming related to the creation, ROC Patent No. 83200405 and U.S. Pat. No. 5,524,300 serve the purpose for references. The commonly known swimming goggle in question are a one piece form comprising frame, nose bridge and protective pads. The main features lie with the combined mount located on the side of the lense frame, along with a stopper on the headband. The offset function of the two after assembly assures no concern of water penetration due to distoration from the pull force created when putting on the goggle. The market reaction to the said patented product has proved to be considerably good after mass production. The structure of which is not only a breakthrough for the customary assembly method of frame, nose bridge and protective pads, the one piece moulding of the three elements above provides more complete and innovative design.

Nonetheless, despite the consumer recognised performance of the innovative structure of the popularly known swimming goggle, from the perspective of production cost, to achieve the pull force distribution during put-on, the stopper must be set against the combined mount. As a consequentce, the production and assembly costs of the stopper are inevitable. Furthermore, to provide accommodation space for the stopper. the combined mount will invariably restrain the vistas of the two sides of the frame, meaning that the visible angles will be narrowed. On account of this, the applicant has thus utilized the concept of refinement and innovative breakthrough to instigate improvement upon the aforementioned patent claim.

OBJECT OF THE INVENTION

Inasmuch, the object of the preferred embodiment as proposed by this invention aims to provide an improvement to the frame, nose rest and protective pads of a pair of one-body goggles so that when they are worn, the facilitation of the unique mechanism of the connecting plate between the headband and the goggle frame could effectively distribute the pull when the goggles are worn, and that may utilizing such a simplified mechanism, the cost will be reduced, combined with a wider viewfinder.

And as a second object of the preferred embodiment as proposed in this invention, it aims to provide a one-body frame, nose and protective pad goggle that is more comfortable to wear with good leakage prevention features.

CHARACTERISTICS OF THE PROPOSED INVENTION

The main characteristic of a new swimming goggle mechanism proposed by this invention lies in, The connecting plate on the swimming goggle frame contains at least one vertical rib into at least two assembly points, which can be used to put through the goggle's headband and strapped across that rib so the rib may absorb the pull when the goggles are worn, and to ensure the frame from being deformed.

The top and bottom of the assembly points have a concave shape that offers strong endurance to the connecting plate's resistance.

Based on the aforementioned main characteristic, the specific dimension of the assembly points segregated by the rib would be commensurate with the thickness of the goggle headband. Furthermore, the configuration of the assembly points can also be designed to match the shape of the goggle headband so that the assembly between the headband and the assembly points are closely joined with the entire goggle's connecting plate to provide superior pull.

BRIEF DESCRIPTION OF ILLUSTRATIONS

PREFERRED PRACTICAL IMPLEMENTATIONS

Figure 1:
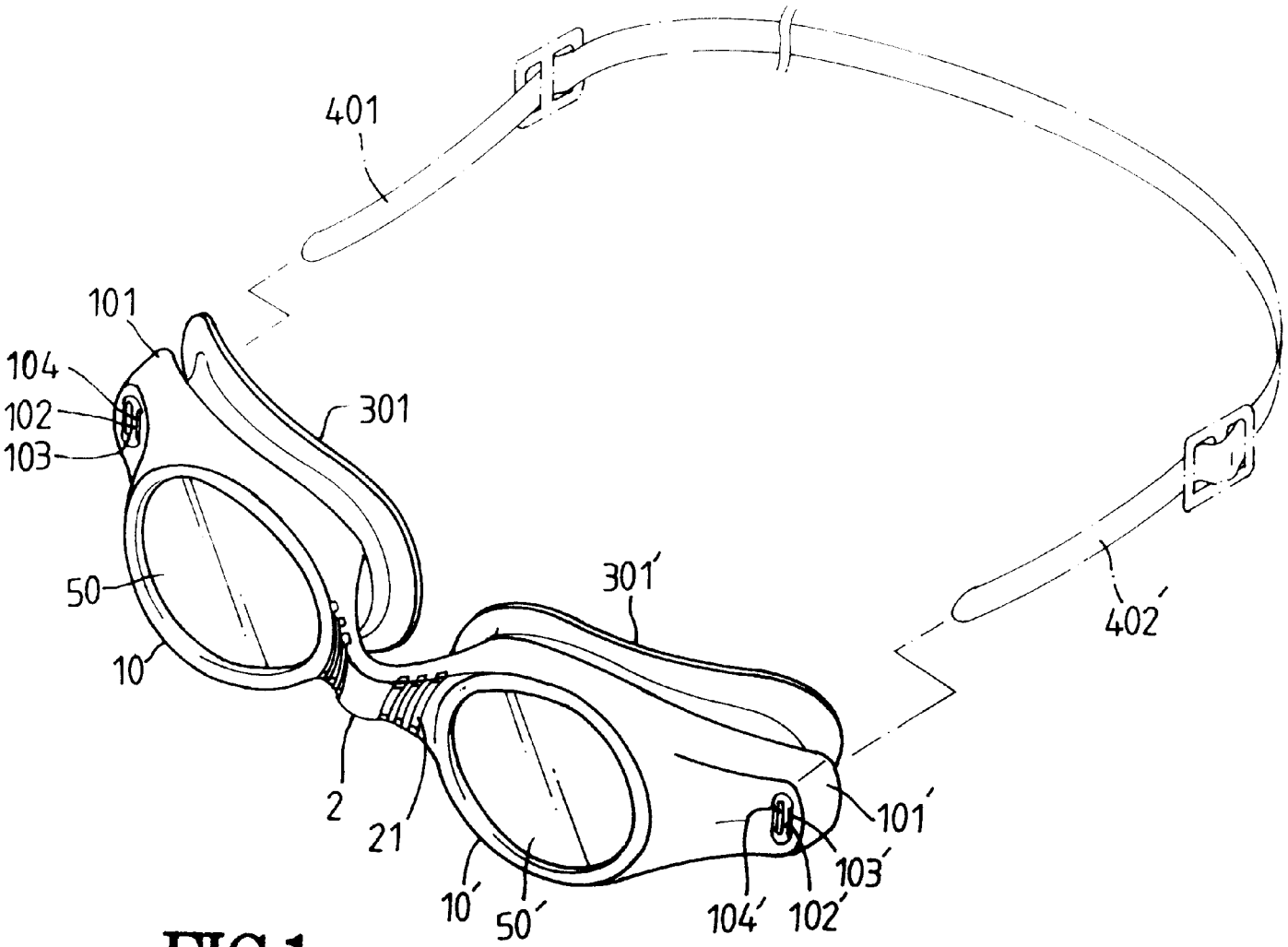
FIG. 1 is of a 3-D perspective view of the preferred embodiment of a swimming goggle as proposed by this invention.
Figure 2:
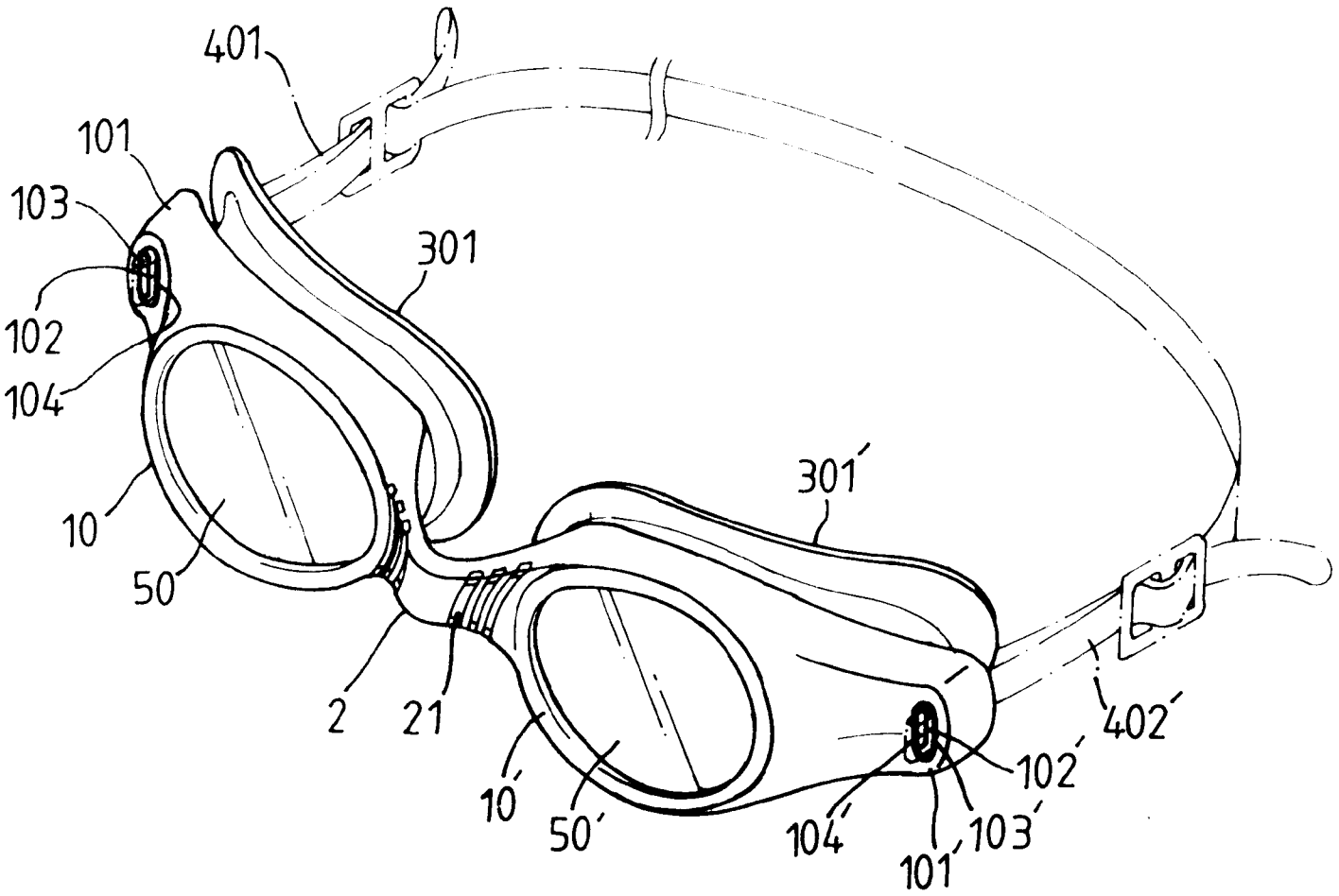
FIG. 2 is of a 3-D assembled view of the preferred embodiment of a swimming goggle as proposed by this invention.

Please refer to FIG. 1 and 2 for the swimming goggle 1 covered by the invention, which include major components of two frames 10, 10', a nose rest 2, two protective pads 30, 31' and a headband device 4. Of which, the two lens frames 10 and 10', the nose rest 2 and two protective pads 30, are formed in one piece. While the two lens frames 10, 10' are positioned on the left and right and inserted with lenses 50 and 50' which are secured to the frames via implantation. In addition, the outside edge of the two lens frames 10, 10' are equipped with two assembly plates 101 and 101', which are used to receive the headband device 4. While each of the connecting plates 101 and 101' are segregated by a rib 102 (or 102') into the first assembly point 103 (or 103'), and the second assembly point 104 (or 104'). The rib 102 (or 102') is of a one-piece molded structure to the connecting plate, while the space of the two assembly points on each side 103 (or 103') and 104 (or 104') is determined by the thickness of the headband 40 in the headband device 4. And the top A and bottom B of the assembly points 103 (or 103') and 104 (or 104') are in a concave shape to provide extra pull on the connecting plates.

In addition, the nose rest 2 is of a one-piece molded structure located between the two lens frames 10 and 10', and is slightly shifted towards above the center line C of the lenses (refer to FIG. 3 for details) so to lessen the direct pull during wear. Accordion grooves have been incorporated at the connecting points to the two lens frames to provide all wearers the flexibility to adjust the goggle to best fit the contour of their facial features for a more comfortable fit over their nose bridge.

The two protective pads 30, are of molded pieces located at the far side to the lenses 50 and 50', with one ends 301 and 301' of the surface that contains adequate flex that can cling to the face with a suction motion to repel water from entering. In addition, the headband device 4 contains a headband 40 and two buckles 41 for adjustment purpose. Two ends 401, 402 of the headband 40 can be inserted through the connecting plate 101, 101' to from a complete device with the two lens frames 10 and 10' (details of connection to be covered in later section). The two buckles 41 are used to control the length of the headband 40 when wearing it.

Figure 3:
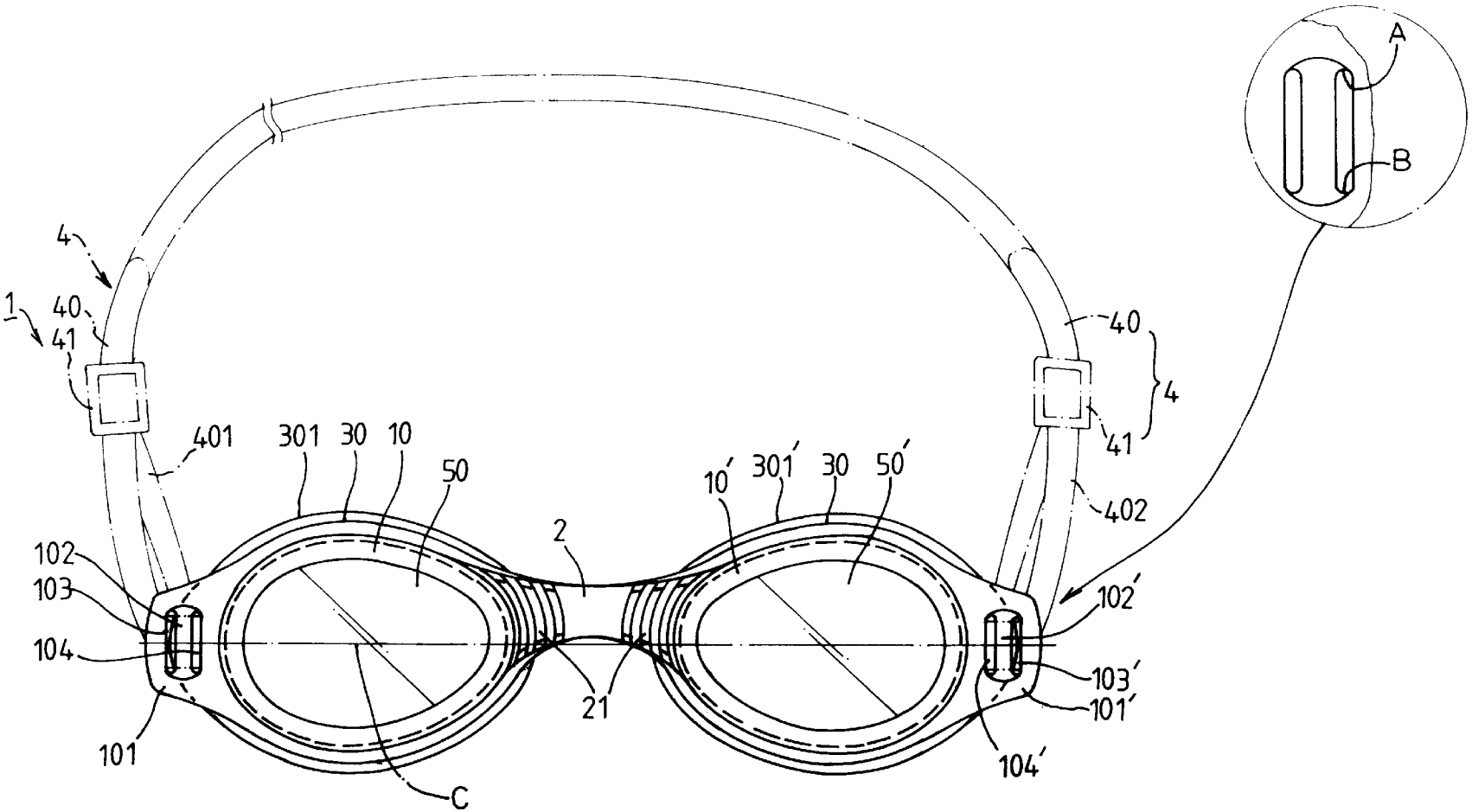
FIG. 3 is a frontal view of the preferred embodiment of a swimming goggle as proposed by this invention.
Figure 4:
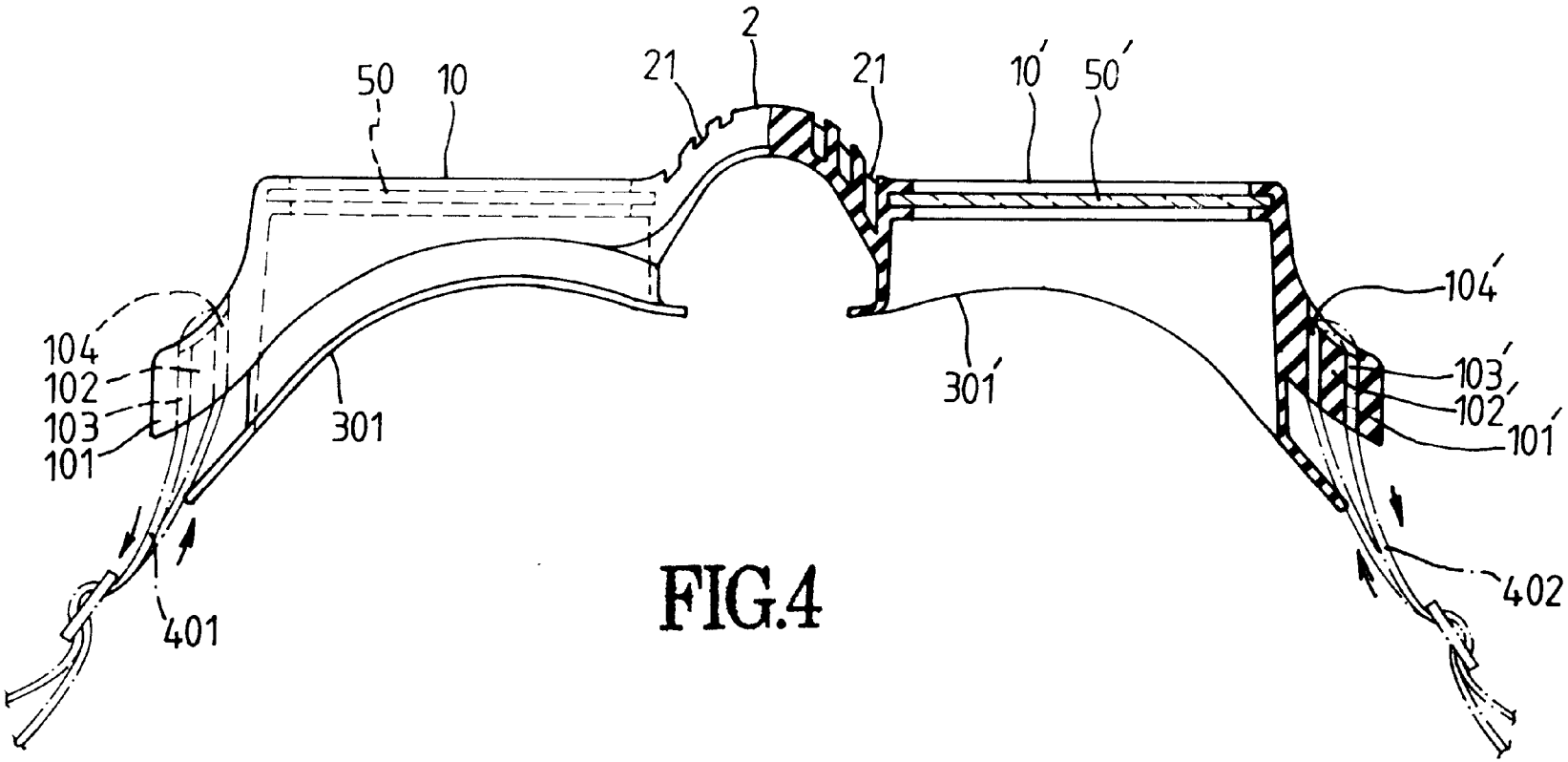
FIG. 4 is a perspective view of an dissection on the preferred embodiment of a swimming goggle as proposed by this invention.

Please refer now to FIGS. 3 and 4, which indicate the assembly of the swimming goggle disclosed in this invention pertains to putting the two ends 401 and 402 of the headband 40 through the first assembly points 103 and 103' of the connecting plates 101 and 101', through the ribs 102 and 102', then pull out of the second assembly points 104 and 104' to complete the task. While the buckle 41 is placed at the end of the headband on each end to provide the wearer to adjust the length of the headband when wearing it. FIG. 4 indicates that when the preferred embodiment proposed by this invention is pulled during wear, the pull will be absorbed by the connecting plates 101, 101', and the ribs 102, 102'; in other words, the pull during wear will not cause any pull to the nose rest 2 or the two lens frames 10 and 10', especially due to that the connection of the headband 40 and the first and second connecting assembly points 103, 103', 104 & 104' is of a one-body connection, that it could further overcome pull during wear. As a result, it not only positions the two lens frames 10, 10' from stretching out of shape, but can also alleviate any concern of water seeping in, thus the superior anti-pull device proposed by this invention will provide better property to prevent seepage.

What has been described above is limited to some of the preferred practical implementations over the proposed invention, while any modifications or variation derived from this invention shall also be construed as within the range of the patent claim.

What is claimed is:

1. A swimming goggle comprising:

a pair of lens frames, each said lens frame accommodating a lens, each said lens frame includes, each connecting plate having assembly points, said assembly points having at an outer end thereof a connecting plate, top and bottom sides of said connecting plates are concave to strengthen pull resistance of said connecting plates, a molded nose rest situated between said lens frames, a pair of protective pads, each said protective pad is attached to a corresponding lens frame, a headband with at least two free ends that are connected to said connecting plates on the lens frames; wherein each said connecting plate includes an opening that receives one of said free ends of said headband, each said opening includes therein at least one vertical rib, and said one of said free ends of said headband is wrapped around said at least one vertical rib to secure said headband in said opening such that each said connecting plate absorbs pulling stress during use of said goggle so as to prevent deformation of said goggle top and bottom sides of said connecting plates are concave to strengthen pull resistance of said connecting plates.

2. The swimming goggle as claimed in claim 1 wherein:

said nose rest is located slightly above a center line of said lenses.

3. The swimming goggle as claimed in claim 2 wherein:

a front side of said nose rest includes a plurality of grooves.

* * * * *